US005617376A

United States Patent [19]

Honzawa et al.

[11] Patent Number: 5,617,376

[45] Date of Patent: Apr. 1, 1997

[54] GEAR TRAIN STRUCTURE OF AN ELECTRONIC WATCH

[75] Inventors: Toyoshige Honzawa; Kuniharu Natori; Nobuhiro Koike, all of Nagano-ken, Japan

[73] Assignee: Seiko Epson Corporation, Tokyo, Japan

[21] Appl. No.: 420,423

[22] Filed: Apr. 12, 1995

Related U.S. Application Data

[62] Division of Ser. No. 157,912, Nov. 24, 1993.

[30] Foreign Application Priority Data

Dec. 2, 1992 [JP] Japan ..... 4-323380

[51] Int. Cl.[6] ..... G04B 19/04; G04B 19/06

[52] U.S. Cl. ..... 368/80; 368/88; 368/220

[58] Field of Search ..... 368/76, 80, 88, 368/203–204, 276, 286, 287, 299, 300

[56] References Cited

U.S. PATENT DOCUMENTS

| | | | |
|---|---|---|---|
| 4,274,153 | 6/1981 | Kume et al. | 368/80 |
| 4,496,246 | 1/1985 | Ota et al. | 368/88 |
| 4,555,184 | 11/1985 | Fujimori | 368/88 |
| 4,726,000 | 2/1988 | Weiss | 368/80 |
| 4,796,240 | 1/1989 | Stevens | 368/281 |
| 4,907,210 | 3/1990 | Sato et al. | 368/80 |

FOREIGN PATENT DOCUMENTS

| | | | |
|---|---|---|---|
| 0342705 | 1/1990 | European Pat. Off. . | |
| 0042079 | 1/1990 | European Pat. Off. . | |
| 2066339 | 1/1990 | France . | |
| 2322396 | 1/1990 | France . | |
| 55-40982 | 3/1980 | Japan | 368/80 |
| 59-18384 | 5/1984 | Japan . | |
| 6451893 | 1/1990 | Japan . | |
| 63190988 | 1/1990 | Japan . | |
| 29895 | 1/1990 | Japan . | |
| 637259 | 1/1990 | Japan . | |
| 4106792 | 1/1990 | Japan . | |
| 233387 | 1/1990 | Japan . | |
| 199082 | 1/1990 | Japan . | |

*Primary Examiner*—Vit W. Miska
*Attorney, Agent, or Firm*—Ladas & Parry

[57] ABSTRACT

A gear train structure of an electronic watch which is high in hand indication accuracy and which eliminates the occurrence of stopping of the watch due to dust, nap or the like. The electronic watch gear train structure includes a second wheel 13 having a minute hand attached thereto, and a braking wheel 15 for applying to the second wheel 13 a rotary torque of a reverse direction to a direction of rotation of the second wheel 13. The braking Wheel 15 includes a gear adapted to mesh with the second wheel 13, a spring 21 having one end thereof fastened to a shaft of the gear, and a balance spring frame 23 having a circumferential wall surface for contacting with the free end side of the spring 21. By vircute of this gear train structure, a rotary torque of a reverse direction to the direction of rotation of the second wheel is always applied to it from the braking wheel 15 and therefore the backlash between the two gears is always closed up in the reverse direction to the direction of rotation of the second wheel.

7 Claims, 8 Drawing Sheets

GEAR TRAIN STRUCTURE OF AN ELECTRONIC WATCH

This is a divisional of copending application Ser. No. 08/157,912 filed on Nov. 24, 1993.

BACKGROUND OF THE INVENTION

The present invention relates to a gear train structure adapted for use in electronic watches.

While the recent trend is toward increasing the accuracy of electronic watches, the method of intermittent hand movement at intervals of a second or so has been employed as the hand movement method for the watches of the analog type and the occurrence of an indication deviation for every hand movement has been a problem. This has been due to the backlash between the fourth wheel to which the second hand is attached and the other wheel in mesh with the fourth wheel and the supporting structure of the hand wheels.

As a conventional method of preventing an indication deviation due to such backlash, there has been known the method of holding down the forward end of the upper tenon of the fouth wheel in the axial direction by a restraining spring so as to apply a restraining force. FIG. 7 of the accompanying drawings is a diagram useful for explaining the conventional indication deviation preventing method shown for example in Japanese Utility Model Registration Publication No. 63-46862. As shown in FIG. 7, the conventional indication deviation preventing method is so designed that a restraining spring 55 presses the forward end of the upper tenon of a fourth wheel 53 to which a second hand 50 is attached and the resulting pressing force prevents any tottering or unsteady movement of the second hand.

However, the upper tenon forward end 53*a* of the fourth wheel 53 is pointed to have a conical shape to improve the assembly performance of the gear train bridge thus :giving rise to a problem that the restraining spring 55 is caused to wear due to its contact with the upper tenon forward end and its durability is deteriorated. There is another problem that the powder caused by the wear enters the gap between the upper tenon portion of the fourth wheel 53 and the tenon guide of the gear train bridge 57, thereby preventing the rotation of the fourth wheel 53 and hence causing the watch to stop.

Also, with the gear train structure of the ordinary electronic watch, as shown in FIG. 7, the rotation of a rotor 59 (a sixth wheel) of a motor is transmitted to the fourth wheel 53 through a fifth wheel 61 and thus the load applied to the fourth wheel 53 has a great influence on the motor efficiency. In other words, if the pressing force of the restraining spring 55 is excessively large, the load applied to the motor is increased and the current consumption is increased thereby reducing the life of the motor.

On the contrary, if the pressing force is excessively small, the tottering of the second hand cannot be reduced to a minimum.

Thus, there is a problem that the pressing force of the restraining spring 55 must be adjusted to such magnitude that no ill effect is produced on the motor efficiency and moreover the tottering of the second hand is reduced to a minimum and that this adjustment is extremely difficult. Where it is desired to vary the load on the gear train, the spring shape or the amount of deflection of the restraining spring are conventionally set anew. However, it is difficult to accurately form the desired spring shape and it is rather difficult to realize the aimed load.

In addition, while the restraining spring 55 applies an axial force to the fourth wheel 53 so that any tottering of the second hand immediately after the wheel movement is reduced somewhat by the axial load, it is impossible to control the angle of rotation of the second hand. In other words, there still exists a problem that the restraining spring 55 is not capable of going to the extent of controlling the indicating position of the second hand and the indicating position is varied thus causing a deviation in the indication of the second hand.

On the other hand, the following two types have heretofore been used as the supporting structures for the hand wheels of the watches in which the three hands including the hour, minute and second hands are arranged concentrically. In other words, as shown in FIG. 8. the first structure is so constructed that a second wheel shaft 65 is secured to a second gear train bridge 83 and a fourth wheel 53 or a second indicating wheel and a second wheel 67 or a minute indicating wheel are respectively rotatably supported by the inner and outer peripheral surfaces of the second wheel shaft 65, and the second structure is so designed that an hour wheel 69 or an hour indicating wheel and a second wheel 67 or a minute indicating wheel are separately arranged and rotatably supported on the inner and outer peripheral surfaces of a center pipe (not shown) fixedly mounted in a base plate.

However, the above-mentioned two structures respectively have the following problems. More specifically, in the case of the first structure (the one including only the second wheel shaft), while the fourth wheel 53 and the second wheel 67 are completely separated from each other in a non-contact manner by the second wheel shaft 65, the hour wheel 69 or the hour indicating, wheel is supported by the outer periphery of the second wheel 87 so that variation in the plane position of the hour wheel 69 includes variation in the plane position or play of the second wheel 67 supporting the former and therefore the deviation in the plane position of the hour wheel 69 is increased. Thus, there results an increase in the variation in the extent of engagement of the toothed portion of the hour wheel 69 thus causing an increase in the amount of backlash and hence an increase in the indication deviation of the hours hand fitted on the hour wheel 69.

Also, in the case of the second structure (the one including only the center pipe), while the hour wheel 69 and the second wheel 67 are completely separated by the center pipe, the minute indicating wheel or the second wheel 67 and the second indicating wheel or the fourth wheel 53 are always in contact and therefore there is the danger of causing the minute hand to jerk in association with the movement of the second hand 50.

Also, the prerequisite of a highly accurate watch requires a condition that the watch is not caused to stop and it is the usually practice with the plane layout of the conventional movement parts (the component parts of the watch excluding the watch case and the battery are referred to as movement parts) to arrange no other component parts or the like between the battery pocket and the gear train pocket thereby interconnecting the battery pocket and the gear train pocket through a space.

With the construction in which no partition is provided between the battery pocket and the gear train pocket as mentioned above, however, there is a problem that when changing the batteries, dust, nap or the like tends to enter through the battery pocket and such dust, nap or the like tends to impede the movement of the gear trains thereby leading to the stoppage of the watch.

SUMMARY OF THE INVENTION

It is the primary object of the present invention to provide a gear train structure for electronic watches which ensures a high degree of hand indication accuracy and which eliminates the occurrence of stopping of the watch due to dust, nap or the like.

To accomplish the above object, in accordance with one aspect of the present invention there is thus provided an electronic watch gear train structure including a plurality of hand wheels each having a hand fitted thereon, at least one gear train for transmitting the rotation of a drive unit to the hand wheels, and braking means for applying to either the gear train or the hand wheels a rotary torque of the reverse direction to the direction of rotation of the gear train or the hand wheels. In accordance with this gear train structure, each of the hand wheels always receives a rotary torque of the reverse direction to the direction of its rotation from the braking means directly or through the gear train so that the hand wheel and the gear engaged therewith are pressed against each other in the reversed direction to the direction of rotation of the hand wheel and thus the backlash of the two gears is always closed up in the reverse direction to the direction of rotation. As a result, the hand wheel is positively rotated in predetermined angular movements without being affected by the backlash thus making it possible to reduce the indication deviation to a minimum. Also, as mentioned previously, each hand wheel is rotated while always receiving a rotary torque of the reverse direction to the direction of its rotation and it rotates in angular movements always under the application of a load. Then, this load serves the function of preventing any tottering of the second hand due to the inertial force immediately after each angular movement and the second hand positively rotates in angular movements without tottering.

In accordance with another aspect of the present invention, the braking means includes a gear adapted to mesh with the gear train or the hand wheel, a spring having its one end attached to the shaft of the gear, and a fixing member having a circumferential wall surface with which the free end side of the spring comes into contact. By constructing the braking means in this way, it is possible to easily vary the rotary torque applied to the hand wheels or the gear train by simply changing the gear ratio between the hand wheel or the gear train and the gear of the braking means. In accordance with still another aspect of the present invention, the electronic watch gear train structure includes at least three hand wheels arranged concentrically and a plurality of fixed hollow shafts each thereof being arranged between the shafts of the hand wheels to rotatably support the shafts. In accordance with this aspect, the hand wheels are completely separated from one another by the fixed hollow shafts and thus the hand wheels are rotated without contacting with one another, thereby completely preventing the occurrence of a phenomenon that the minute hand jerks in response to the movement of the second hand and a phenomenon that the minute hand jerks in response to an adjusting movement of the hour hand.

In accordance with still another aspect of the present invention, the electronic watch gear train structure includes a gear train pocket located substantially in the vicinity of the center of the movement, a pocket for a power supply which supplies a power to the watch gear train, and movement parts including partition walls for partitioning a space interconnecting the gear train pocket and the power supply pocket. In accordance with this aspect, the gear train pocket and the power supply pocket are separated from each other by the movement parts and the resulting gear train structure is not only capable of preventing the dust or the like deposited on the power supply, e.g., a battery from entering into the gear train section and reducing the stoppage of the watch but also high in reliability.

The above and other objects as well as advantageous features of the invention will become clearer from the following description taken in conjunction with the drawings.

DESCRIPTION OF THE PREFERRED EMBODIMENTS

Figure 1:
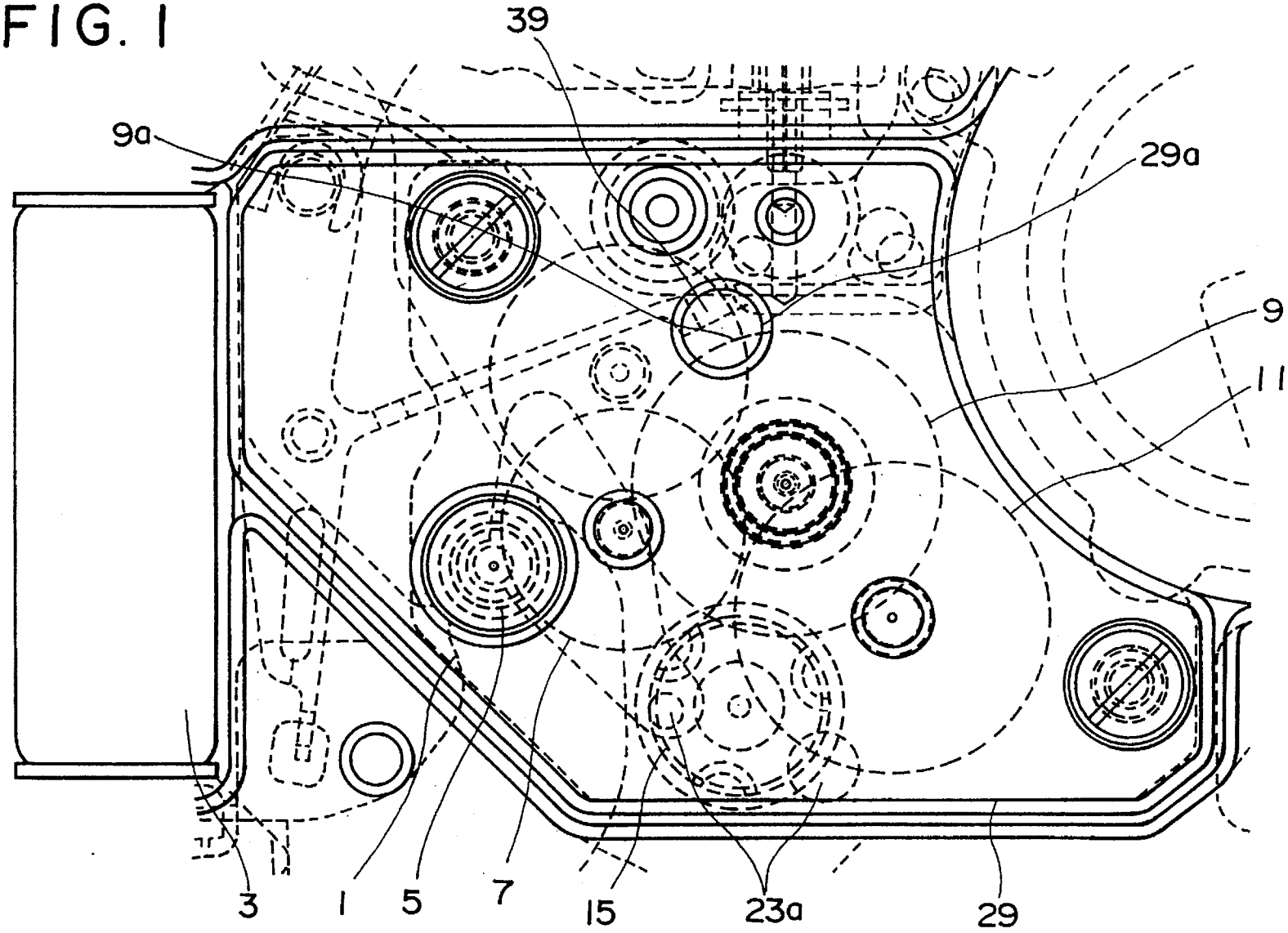
FIG. 1 is a plan elevation showing a Gear train structure of an electronic watch according to an embodiment of the present invention.
Figure 2:
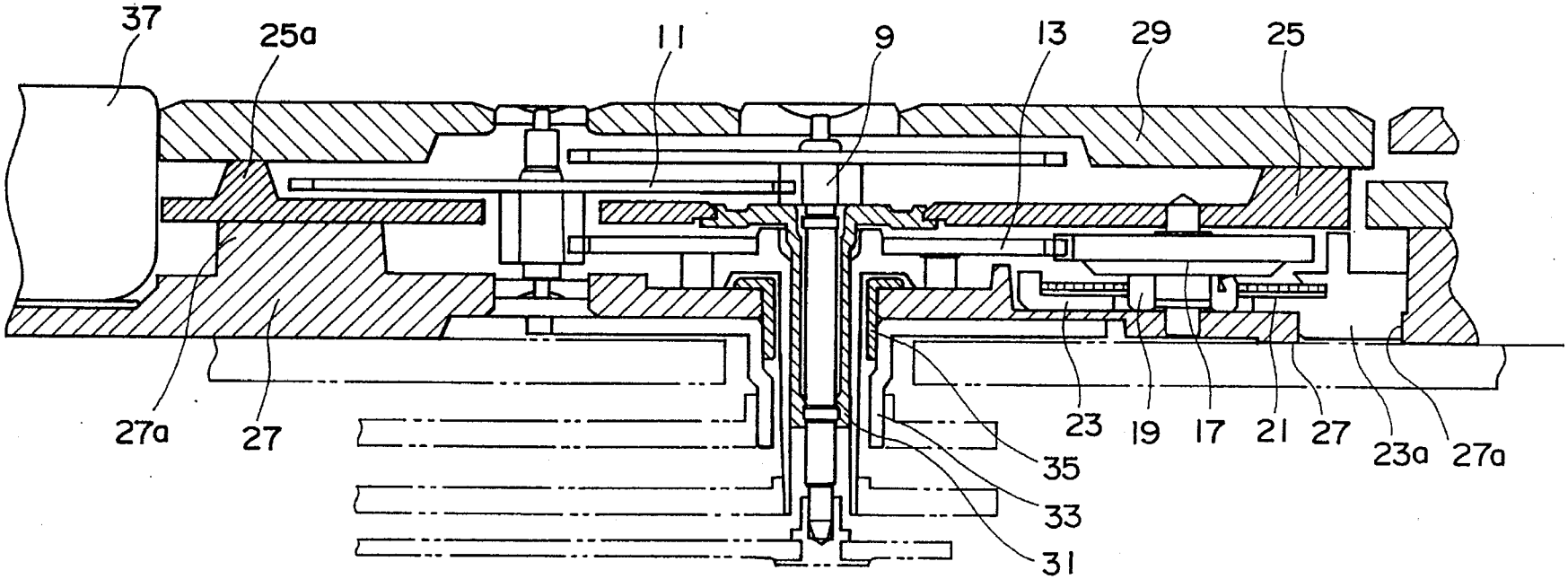
FIG. 2 is a sectional view of FIG. 1.

FIG. 1 is a plan view showing an example of a gear train structure according to the present invention, and FIG. 2 is a sectional view of the gear train structure of FIG. 1. An embodiment of the invention will now be described with reference to FIGS. 1 and 2. Usually, a time indicating gear train is moved by a stepping motor including a stator 1, a coil block 3 and a rotor 5. Then, the rotation of the rotor 5 is transmitted to a second indicating wheel or a fourth wheel 9 through a fifth wheel 7 and the rotation is also transmitted to a minute indicating wheel or a second wheel 13 through a third wheel 11.

Engaged with the second wheel 13 is a braking wheel 15 for applying a given torque to the second wheel 13 to brake the rotation of the second wheel 13. The braking wheel 15 includes a balance spring pinion 17 having a gear which meshes with the second wheel 13, a collet 19 attached to the lower part Of the balance spring pinion 17, a balance spring 21 having its one end attached to the collet 19, and balance spring frame 23 for receiving the balance spring 21 in a condition where the free end of the balance spring 21 inscribes it. The balance spring pinion 17 includes upper and lower tenons which are respectively rotatably supported in a second gear train bridge 25 and a base plate 25, and the balance spring frame 23 is assembled in place by fitting its dowel 23*a* in a dowel hole 27*a* formed in the base plate 27.

Figure 3:
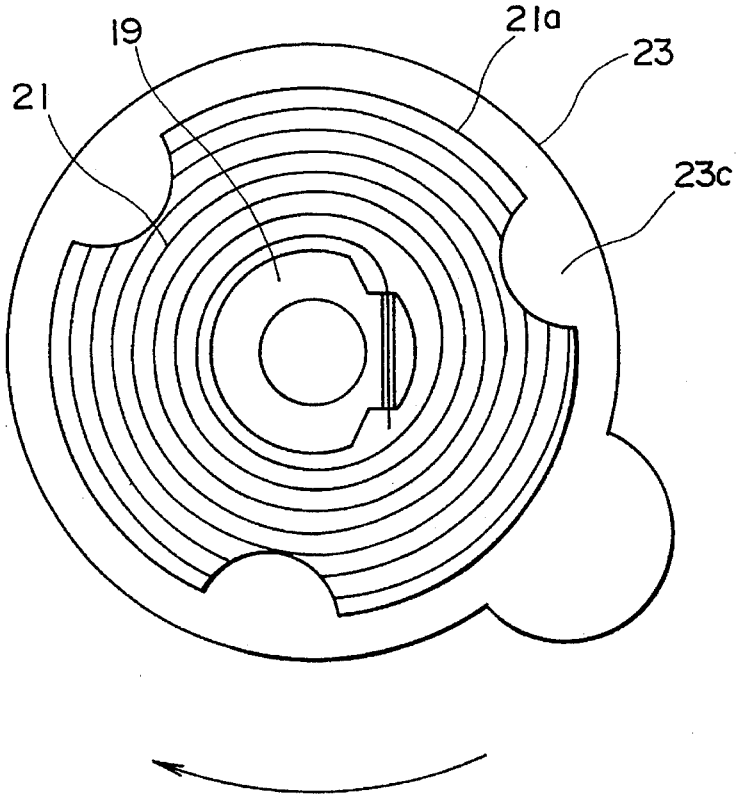
FIG. 3 is a diagram useful for explaining the component parts of the braking wheel.

FIG. 3 is a schematic diagram useful for explaining the manner in which the balance spring 21 is received in the balance spring frame 23. As shown in the Figure, the balance spring 21 is received in its wound-up condition within the balance spring frame 23 and the free end 21*a* of the balance spring 21 is in contact with the inner wall of the balance spring frame 23. Also, the balance spring frame 23 is formed on its upper surface with canopy portions 23*c* for preventing the balance spring 21 from getting out of the balance spring frame 23.

Figure 4:
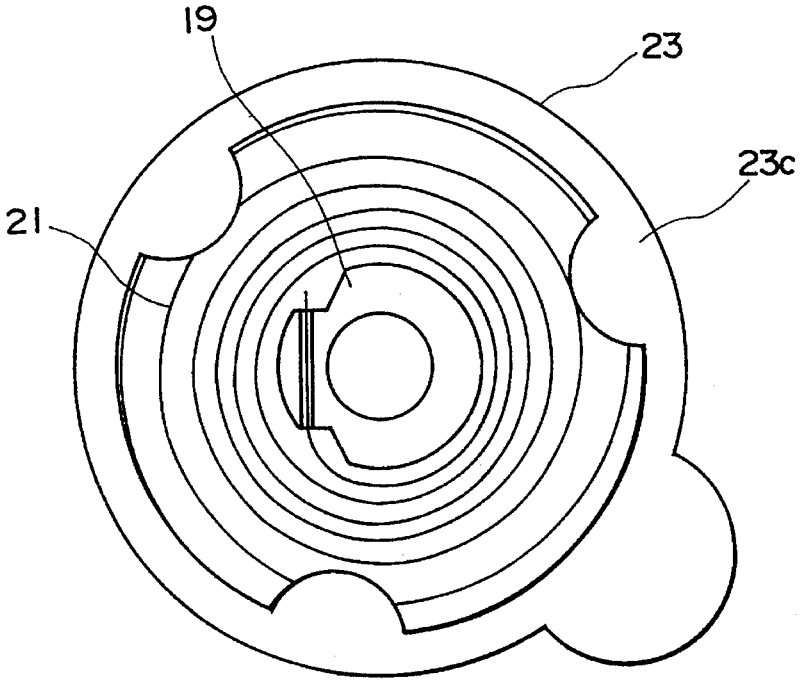
FIG. 4 is a diagram for explaining the manner in which the braking wheel of FIG. 3 is used.

Next, with the construction described above, the operation of the embodiment will be described. By virtue of the above-mentioned mechanism, the rotation of the rotor 5 is transmitted to the second wheel 13 so that when the balance spring pinion 17 is in turn rotated by the second wheel 13, the balance spring 21 is wound up as shown in FIG. 4. Then, as the balance spring pinion 17 is rotated further, the free end at the outermost periphery of the balance spring 21 is pressed against the inner wall of the balance spring frame 23 and in this condition the balance spring 21 is rotated while being subjected to a frictional resistance from the inner wall of the balance spring frame 23. As mentioned previously, the balance spring pinion 17 is rotated with the balance spring 21 being kept in its wound-up condition so that the force tending to wind off the wound-up balance spring 21 applied to the balance spring pinion 17 a rotary torque of the reverse direction to the rotation due to the second wheel 13. This rotary torque is transmitted through a path reverse to that for the previously mentioned transmission of the rotation of the rotor 5, i.e., the path through the balance spring pinion 17, the second wheel 13, the third wheel 11, the fourth wheel 9 and the fifth wheel 7 so that each of the gear s receives the rotary torque of the reverse direction to the rotation applied by the rotor 5 and the respective gears in mesh are brought into contact at one surfaces thereof. As a result, the gear of the second indicating wheel or the fourth wheel 9 is also brought into contact at its one surface with the gear of the fifth wheel 7 so that no play due to any backlash is caused and the second position is positively rotated in predetermined angular movements. In .other words, the thus realized gear train structure has extremely less danger of causing any second position deviation.

Also, the fourth wheel 9 is always rotated under the application of the torque of the reverse direction to the rotation due to the rotor 5 and it is always rotated in angular movements under the application of a load. Thus, this load serves the function of preventing any tottering of the second hand caused by the inertial force immediately after angular movements and the second hand is positively rotated in angular movements without tottering or unsteadiness.

It is to be noted that while the above-mentioned embodiment shows the case in which a balance spring is used for the spring member which applies a rotary torque to the balance spring pinion 17, this is due to the following reasons. In other words, where the gear ratio between the balance spring pinion 17 and the second wheel 13 is constant, the magnitude of a rotary torque applied to the second wheel 13 is determined by the spring force of the balance spring 21. Thus, in order to make the rotary torque constant, it is necessary to make constant the spring force of the balance spring 21. However, Generally the spring force is affected by the spring shape and an error is caused in the spring forces far as the spring shape involves an error. Therefore, by forming a spring into such shape that the length of the spring becomes extremely long as compared with its Section as in the case of a balance spring, it is possible to reduce the effect of a shape error on the spring force as compared with a spring of a short length and there is no danger of the rotary torque being varied by any error in the spring shape, the number of turns in the spring the spring outer diameter or the like, thereby making it possible set a stable rotary torque. This means that the ill effect on the performance of a structure due to errors in the production of component parts can be reduced considerably and a stable quality can be ensured.

Here, it is needless to say that any spring other than the .balance spring can be used provided that it has a length corresponding to the radius of the inner periphery of the balance spring frame 23.

Further, while the above-described embodiment shows the case in which the inner end of the balance spring 21 is fastened and its outer end serves as the free end, it is possible to construct contrariwise so that the outer end of the balance spring 21 is fastened and its inner end serves as the free end.

Where it is desired to vary the load applied to the gear train, it is only necessary to vary the number of teeth on the balance spring pinion 17 or the gear ratio between it and the second wheel 13. Therefore, the load on the gear train can be simply and accurately varied without changing the difficult setting of the balance spring 21.

Figure 9:
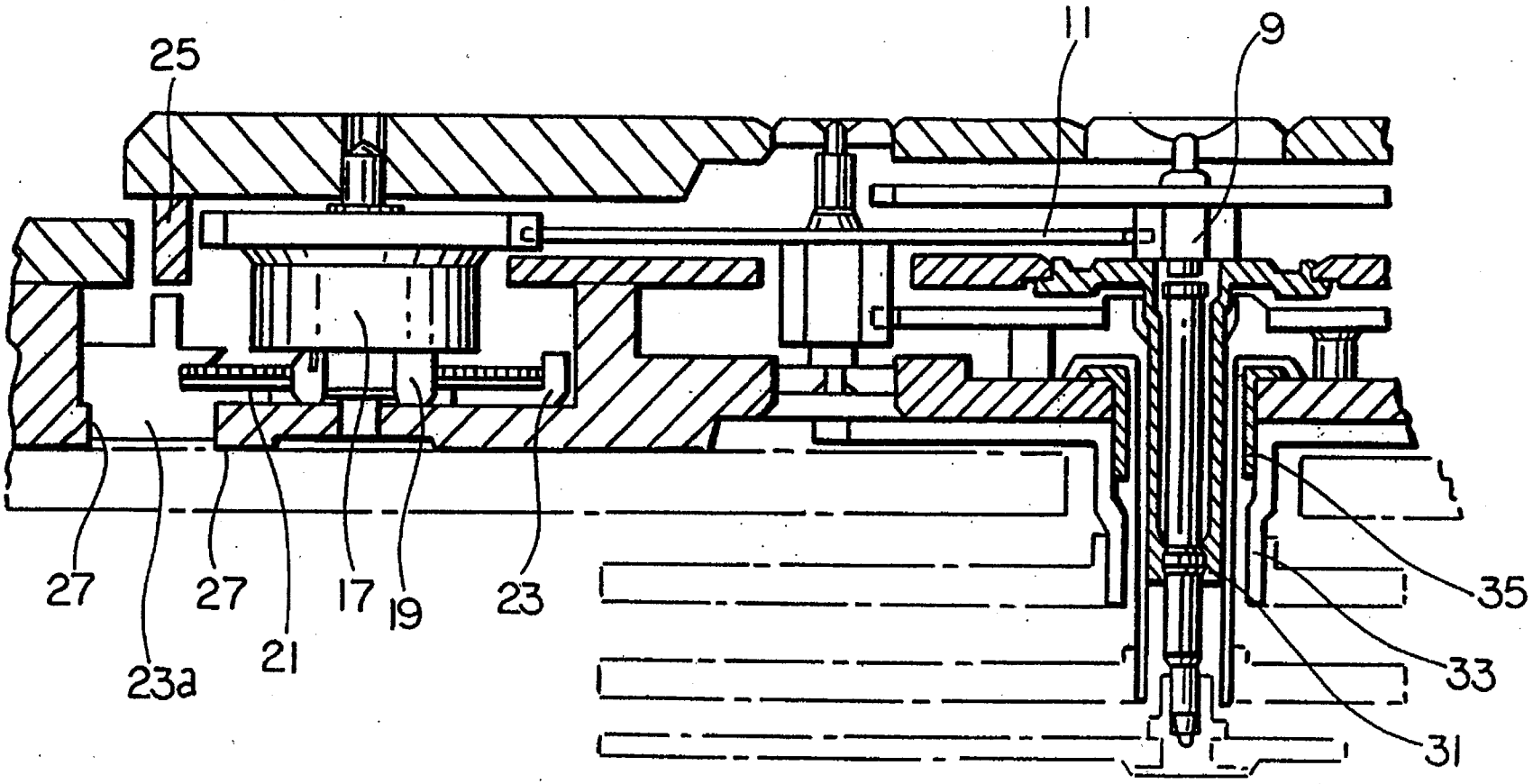
FIG. 9 is a partial sectional elevation of a gear train structure of another embodiment.
Figure 10:
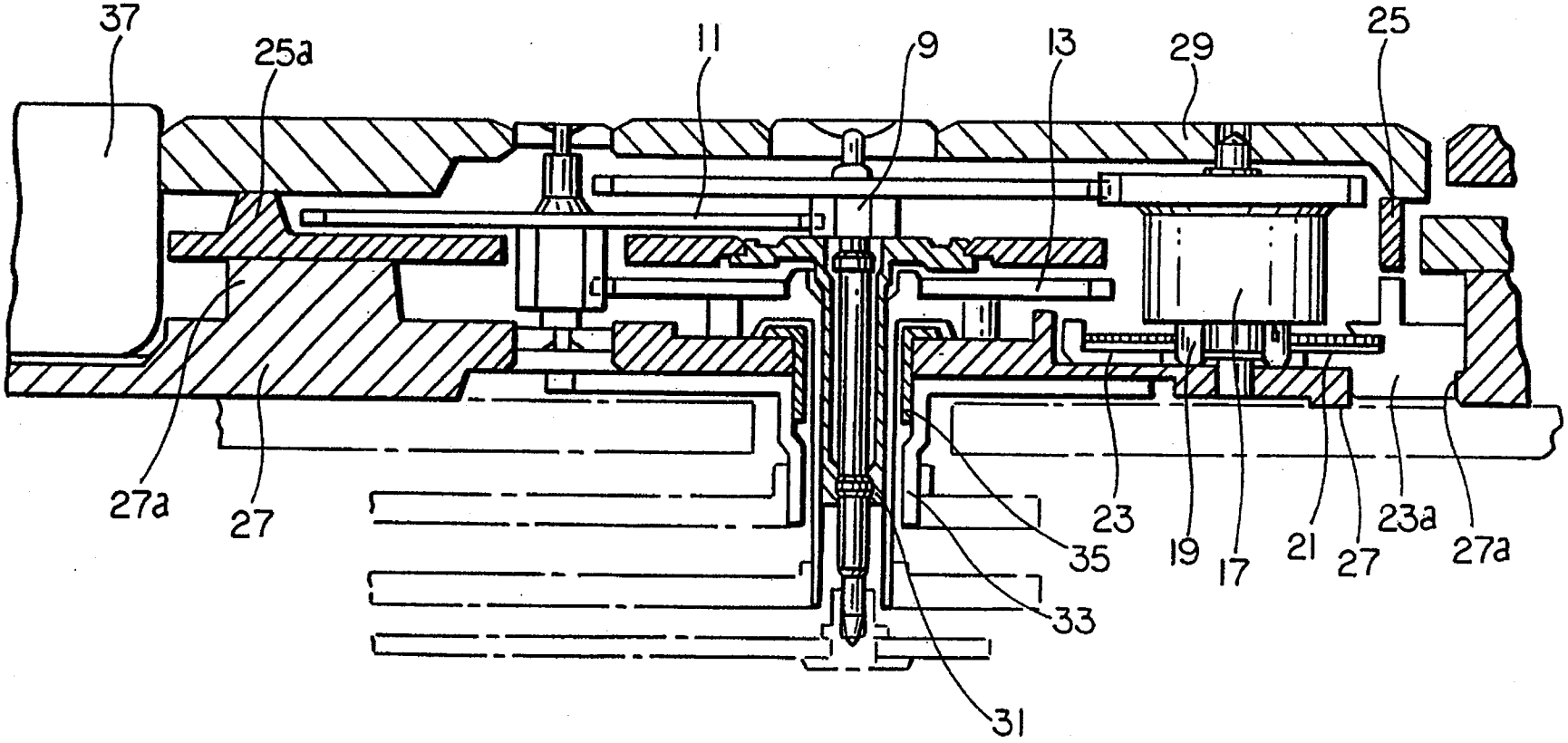
FIG. 10 is a partial sectional elevation of a gear train structure of another embodiment.

Still further, while the above-described embodiment shows the case in which the balance spring pinion 17 is in mesh with the second wheel 13, the same effect as the present embodiment can be obtained by an arrangement such that the balance spring pinion 17 is rotatably fitted in the second gear train bridge 25 (FIG. 9) or a gear train bridge 29 (FIG. 10) and the balance spring pinion 17 is brought into mesh with the third wheel 11 (FIG. 9) or the fourth wheel 9 (FIG. 10). In other words, the structure of the present embodiment allows to conceive a number of layouts to suit any desired gear train structure and therefore it can be said to have excellent general-purpose properties.

Still further, while the present embodiment shows the case in which the method of fastening the collet 19 and the balance spring pinion 17 together consists of drive fitting the shaft of the balance spring pinion 17 into the hole of the collet 19 to fasten them together, by forming for example the hole of the collet 19 into an irregular shape (e.g., an elliptic shape) and forming the shaft of the balance spring pinion 17 into a shape that can be fitted into the hole; during the assembling the collet 19 and the balance spring pinion 17 can be simply put together without drive fitting the latter into the former. Even with this construction, the rotary torque of the balance spring 21 can be transmitted to the balance spring pinion 17 and the same effect as the present embodiment can be obtained. Further, since this construction eliminates the need to drive fit the balance spring pinion 17 into the collet 19, the manhours for parts forming purposes, i.e., those required for drive fitting the balance spring pinion 17 into the collet 19 can be reduced and moreover a reduction in the cost of parts can be attained by using the balance spring pinion 17 made of a plastic material.

On the other hand, the conventional restraining spring shown in Japanese Utility Model Registration Publication No. 63-46862 is arranged between the gear train and the screw in section so that any variation in the thickness of the restraining spring causes a variation in the amount of engagement between the shank guide bush and the screw and the thickness of the watch is affected. With the gear train structure of the present embodiment, however, the braking wheel 15 is arranged between the second gear train bridge 25 and the base plate 27 and therefore the thickness of the watch is not affected at all. In other words, there is the effect of preventing any second position deviation and hand tottering without causing any effect on the thickness of the watch.

Figure 5:
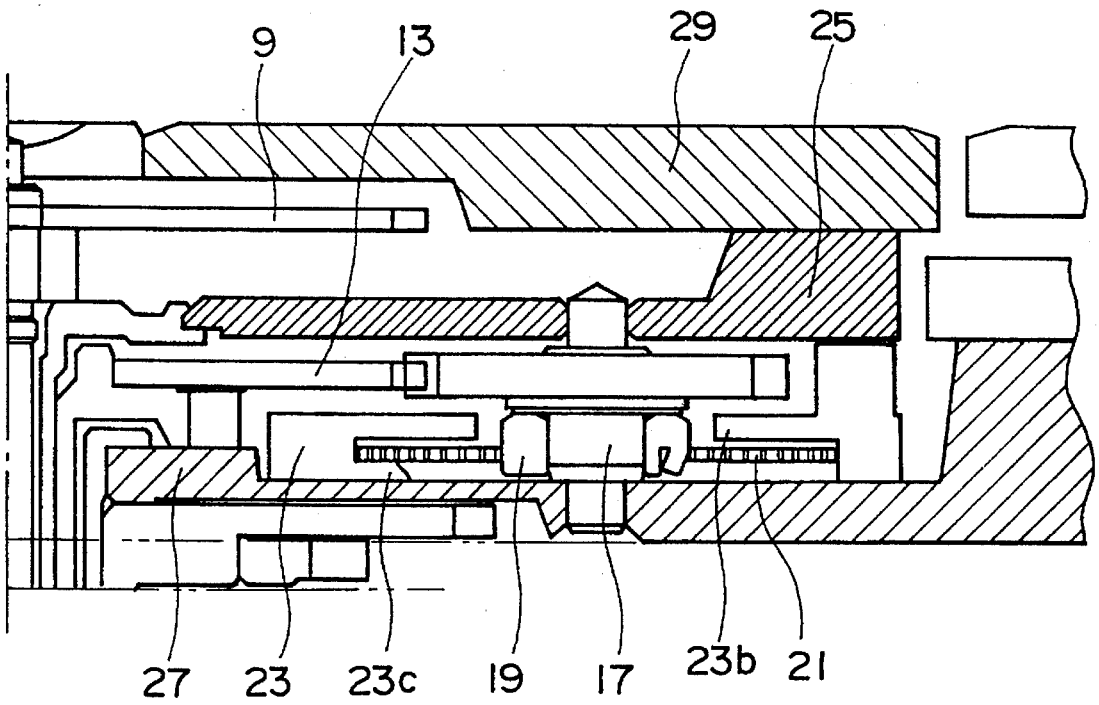
FIG. 5 is a sectional view showing the principal part of another embodiment of the invention.
Figure 6:
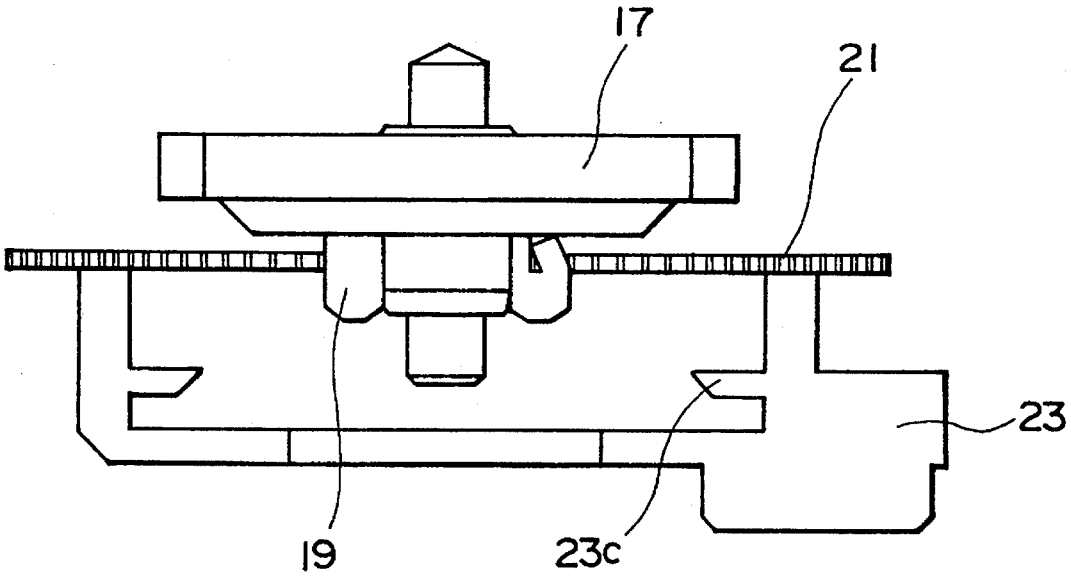
FIG. 6 is a schematic diagram for explaining the deficiencies of the embodiment.
Figure 7:
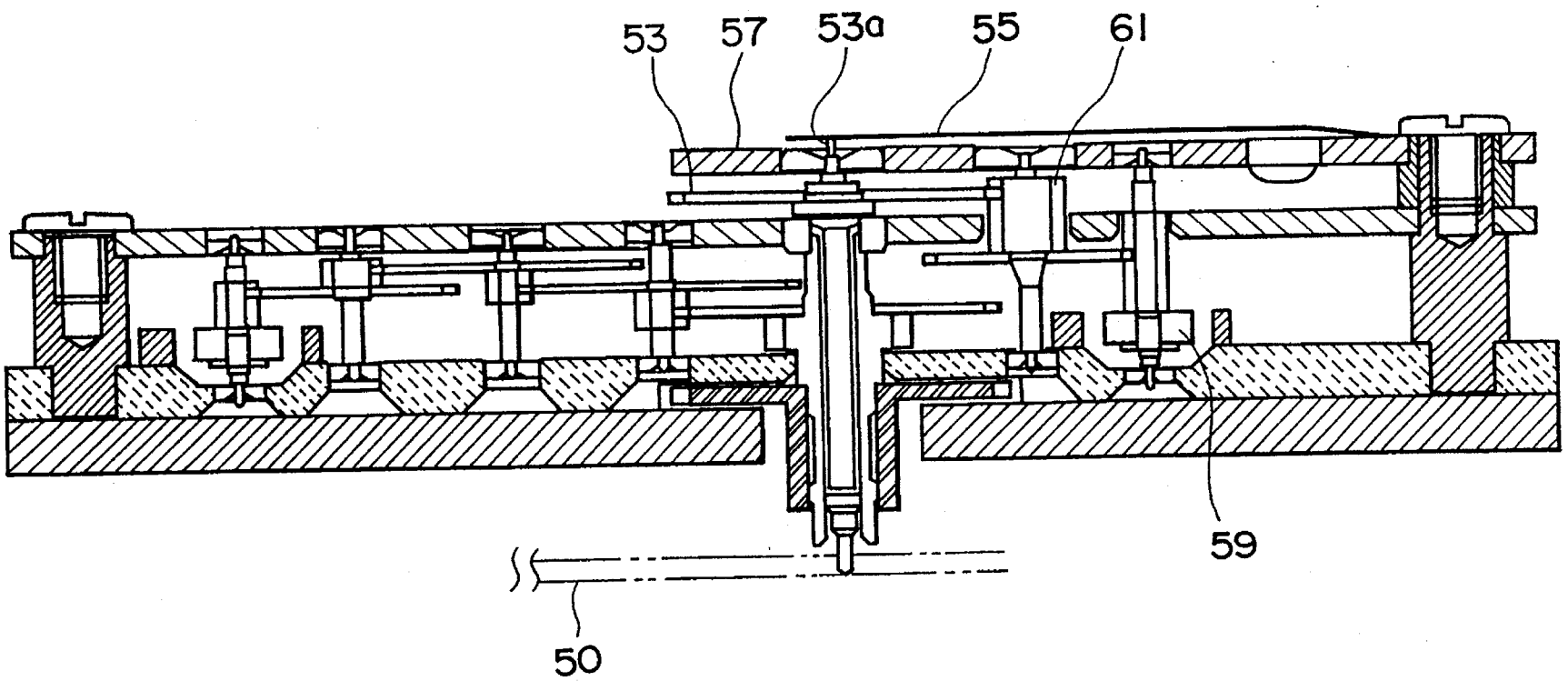
PRIOR ART FIG. 7
FIG. 7 is a sectional elevation showing a conventional electronic watch gear train structure.
Figure 8:
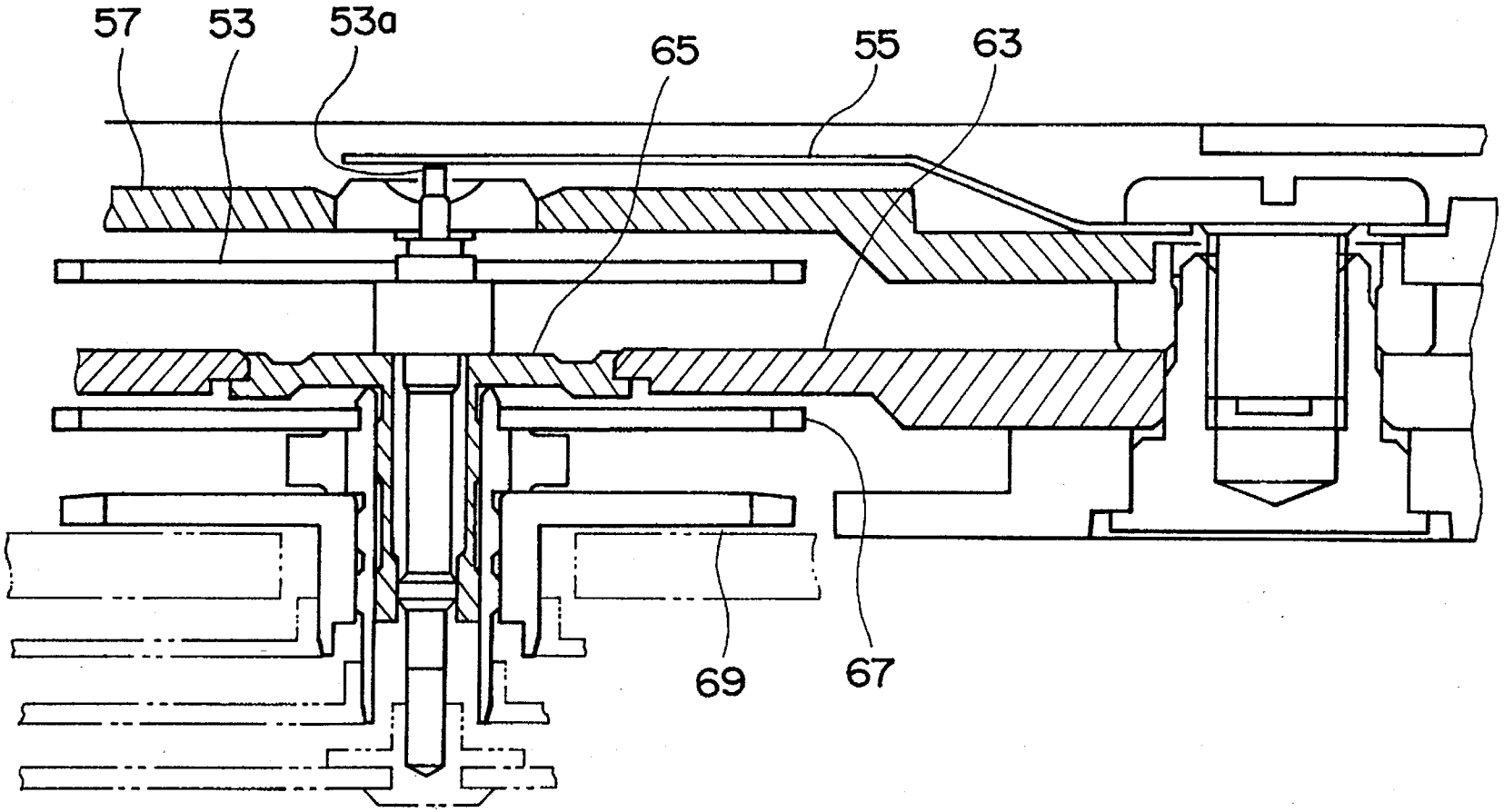
FIG. 8 PRIOR ART
FIG. 8 is a sectional elevation showing the principal part of the conventional electronic watch gear train structure.

FIG. 5 shows another embodiment of the present invention in which the arragement of the balance spring frame 23 is upside down as compared with FIG. 2 so that the bottom portion 23*b* and the canopy portions 23*c* of the balance spring frame 23 are respectively arranged in opposition to the second gear train bridge 25 and the base plate 27. In accordance with this construction, when the braking wheel is raised by holding the upper tenon of the balance spring pinion 17, the balance spring 21 is kept by the bottom portion 23*b* and therefore there is no danger of the balance spring 21 getting out of the balance spring frame 23 to cause a condition such as shown in FIG. 6 contrary to the case in which the canopy portions 23*c* of the balance spring frame 23 are on the upper side.

Also, instead of forming the location projection, e.g., the dowel on the balance spring frame 23 as in the previously mentioned embodiment, it is possible to construct so that the positioning of the braking wheel 15 is effected by the external shape of the balance spring frame 23 as shown in FIG. 5, with the result that the shape of the balance spring frame 23 is simplified and this leads to a reduction in the cost of parts.

Next, the method of holding the hand wheels will be described with reference to FIG. 2. The second indicating wheel or the fourth wheel 9 is rotatably supported by the stepped portion formed on the inner peripheral surface of a second wheel shaft 31 fixedly mounted in the second gear train bridge 25, and the minute indicating wheel or the second-wheel 13 is rotatably supported by the stepped portion formed on the outer peripheral surface of the second wheel-shaft 31. Also, the hour indicating wheel or an hour wheel 33 is rotatably supported by the outer peripheral surface of a center pipe 35 fixedly mounted in the base plate 25. Thus, it is constructed so that the second, minute and hour indicating hand wheels are separated completely from one another .and the hand wheels are rotated without contacting with one another.

As a result, it is possible to completely prevent the occurrence of a phenomenon in which the minute hand is caused to totter in response to the movement of the second hand. Also, where the watch has a time error correcting function, it is possible to completely prevent the occurrence of a phenomenon in which the minute hand is caused to .totter in response to the correcting movement of the hour hand.

Further, since each of the hand wheels is supported by the second wheel shaft 31 or the center pipe 35 in a completely independent manner as mentioned previously, there is no possibility of a situation arising in which the second wheel is guided by the fourth wheel .or the hour wheel is guided by the second wheel as in the case of the prior art. Therefore, the plane position of each hand wheel is not affected by the other hand wheels and the plane position is accurately determined for each hand wheel independently of the other hand wheels. As a result, the backlash between each of the hand wheels and the corresponding mating gear can be set to a reduced value and the indication deviation Of each hand wheel due to the backlash can be reduced to a minimum.

The plane layout of the movement parts will now be described with reference to FIG. 2. in the present embodiment, as shown in FIG. 2, the space interconnecting the pocket of a battery 37 and the gear train pocket is completely divided into two parts by a wall 27*a* formed on the base plate 27 and a wall 25*a* formed on the second gear train bridge 25. Therefore, when replacing the battery 37, dust, nap or the like can be prevented from entering into the gear train.

Further, where a hole 29*a* is provided to observe the manner in which the teeth 9*a* of the fourth wheel 9 are controlled by a control lever 39 from the upper surface of the gear train bridge 29 as shown in FIG. 1, by fitting a transparent sheet or the like in the hole 29*a*, it is possible to prevent the dust, nap or the like deposited on the movement from entering into the gear train section through the hole 29*a* upon the opening of the back cover.

It will be seen from the foregoing description that the present invention has the effect of preventing the entry into the gear train section of dust, nap or the like tending to cause stopping of the watch and thereby reducing the stopping of the watch and enhancing its reliability.

What is claimed is:

1. A gear train structure for an electronic watch, the gear train structure comprising:

a gear train pocket in which a plurality of gears are rotatably supported by a base plate and at least one gear train bridge, and a power supply pocket for receiving a power supply to supply electric power to said gear train pocket, wherein said base plate and said gear train bridge have projection portions and are stacked so that said gear train pocket and said power supply pocket are separated from each other by said projection portions as a partition.

2. A gear train structure according to claim 1, further comprising:

a plurality of hand wheels each thereof having a hand attached thereto;

at least one gear train for transmitting rotation of a drive unit to said hand wheels; and braking means for applying to said gear train a rotary torque of a reverse direction to a direction of said gear train.

3. A gear train structure according to claim 2, wherein said braking means comprises:

a gear adapted to mesh with said gear train;

a spring having one end thereof fastened to a shaft of said gear; and a fixing member having a circumferential wall surface for connecting with a free end side of said spring.

4. A gear train structure according to claim 1, further comprising:

a plurality of hand wheels each thereof having a hand attached thereto;

at least one gear train for transmitting rotation of a drive unit to said hand wheels; and braking means for applying to said hand wheels a rotary torque of a reverse direction to a direction of rotation of said hand wheels.

5. A gear train structure according to claim 4, wherein said braking means comprises:

a gear adapted to mesh with one of said hand wheels;

a spring having one end thereof fastened to a shaft of said gear; and a fixing member having a circumferential wall surface for contacting with a free end side of said spring.

6. A gear train structure according to claim 1, further comprising:

at least three shaft portions of hand wheels arranged concentrically in a state of insertion; and a plurality of fixed hollow shafts each thereof being arranged between each of said shaft portions whereby each of said shaft portions is rotatably supported without having contact with another shaft portion.

7. In a timepiece having a gear train structure, the improvements comprising:

a gear train pocket in which a plurality of gears are rotatably supported by a base plate and at least one gear train bridge, and a power supply pocket for receiving a power supply to supply electric power to said gear train pocket, wherein said base plate and said gear train bridge have projection portions and are stacked so that said gear train pocket and said power supply pocket are separated from each other by said projection portions as a partition.

* * * * *